US005115647A

United States Patent [19]

Luck-Hoehn

[11] Patent Number: 5,115,647

[45] Date of Patent: May 26, 1992

[54] JEWELRY APPARATUS

[76] Inventor: Rhonda F. Luck-Hoehn, 408 W. Park St., Rome, N.Y. 13440

[21] Appl. No.: 657,401

[22] Filed: Feb. 19, 1991

[51] Int. Cl.[5] ..... A44C 7/00

[52] U.S. Cl. ..... 63/12; 63/13; 63/2; D11/49; 446/319; 446/391

[58] Field of Search ..... 63/12, 13, 14.1-14.8, 63/1.1, 2, 23; D11/40, 43, 44, 49, 79, 82; 446/319, 391

[56] References Cited

U.S. PATENT DOCUMENTS

| | | | |
|---|---|---|---|
| D. 64,445 | 4/1924 | Dobie | D11/43 |
| D. 77,424 | 1/1929 | Mechlovits | D11/49 |
| 420,508 | 2/1890 | Blassing | 63/23 |
| 2,080,060 | 5/1937 | Placco | 63/1.1 |
| 3,156,999 | 11/1964 | Dean | 446/319 |
| 3,533,247 | 10/1970 | Douglas | 63/13 |
| 4,779,778 | 10/1988 | Nixon | 63/1.1 |
| 4,879,882 | 11/1989 | Johnson | 63/13 |

FOREIGN PATENT DOCUMENTS

| | | | |
|---|---|---|---|
| 752167 | 7/1956 | United Kingdom | 63/13 |

*Primary Examiner*—Renee S. Luebke
*Assistant Examiner*—F. Saether
*Attorney, Agent, or Firm*—Leon Gilden

[57] ABSTRACT

An organization wherein panels are secured by sewing or other mechanical or adhesive fasteners to define a pyramidal construction, with an opening at its upper end to receive a shank of a jewelry member such as an earring therethrough, the clasp extending above the pyramidal construction. A forward panel member is mounted to the pyramidal construction. The organization may be further applied to covering for necklace and ring construction, wherein the cover panel is utilized as a covering for a ring or necklace construction. An alternative jewelry apparatus is defined by at least one clip member associated for each year of an individual, wherein the clip member is defined by a frontal panel of a generally diamond shaped configuration and a complementarily configured rear panel of a like configuration. Elongate "L" shaped portions defining ears are directed upwardly from an upper apex of the frontal panel, with the frontal panel defining a simulation of a rabbit-like visage. Interiorly of the front and rear panel is a spring clip assembly to normally bias the panels with the upper apex of each of the front and rear panels relative to one another, wherein the panels may be spread to define a slot for receiving an individual's ear lobe therewithin by depressing lowermost apex portions of each front and rear panel.

6 Claims, 4 Drawing Sheets

JEWELRY APPARATUS

BACKGROUND OF THE INVENTION

1. Field of the Invention

The field of invention relates to jewelry organizations, and more particularly pertains to a new and improved jewelry apparatus wherein the same is readily assembled to define a covering tent-like structure for a jewelry member.

2. Description of the Prior Art

Jewelry coverings aand various jewelry construction has been utilized in the prior art to define jewelry of an ornamental configuration for usage by individuals. Such prior art may be found in U.S. Pat. No. 3,958,430 to Barron setting forth a clip member utilizing a retaining means for pressing and positioning an ear portion against an associated head of an individual.

U.S. Pat. No. 2,282,336 to Meyer provides an earring or ring constructtion utilizing a wire and bead-like assembly.

U.S. Pat. No. 2,669,102 to Ronstadt provides an ear ornament wherein a plurality of plates are biased together to secure an ear lobe therebetween in an ornamental arrangement.

U.S. Pat. No. 3,739,599 to Melone provides for a resilient earring member applying pressure to opposed sides of an ear lobe.

U.S. Pat. No. 4,257,241 to Voccio, et al. provides an earring construction with a main body, including a resilient leg to secure an ear lobe between the main body and the resilient leg.

As such, it may be appreciated that there continues to be a need for a new and improved jewelry apparatus wherein the same provides an organization of convenient construction and ease of use in providing various jewelry members.

SUMMARY OF THE INVENTION

In view of the foregoing disadvantages inherent in the known types of jewelry apparatus now present in the prior art, the present invention provides a jewelry apparatus wherein the same provides for a covering member to provide various configurations in association with an earring assembly. As such, the general purpose of the present invention, which will be described subsequently in greater detail, is to provide a new and improved jewelry cover assembly which has all the advantages of the prior art jewelry organizations and none of the disadvantages.

To attain this, the present invention provides an organization wherein panels are secured by sewing or other mechanical or adhesive fasteners to define a pyramidal construction, with an opening at its upper end to receive a shank of a jewelry member such as an earring therethrough, the clasp extending above the pyramidal construction. A forward panel member is mounted to the pyramidal construction. The organization may be further applied to covering for necklace and ring construction, wherein the cover panel is utilized as a covering for a ring or necklace construction. An alternative apparatus is defined by at least one clip member associated for each ear of an individual, wherein the clip member is defined by a frontal panel of a generally diamond shaped configuration and a complementarily configured rear panel of a like configuration. Elongate "L" shaped portions defining ears are directed upwardly from an upper apex of the frontal panel, with the frontal panel defining a simulation of a rabbit-like visage. Interiorly of the front and rear panel is a spring clip assembly bias the panels, with the upper apex of each of the front and rear panels relative to one another, wherein the panels may be spread to define a slot for receiving an individual's ear lobe therewithin by depressing lowermost apex portions of each front and rear panel.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent Trademark office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved jewelry apparatus which has all the advantages of the prior art jewelry oraganizations and none of the disadvantages.

It is another object of the present invention to provide a new improved jewelry apparatus which may be easily and efficiently manufactured and marketed.

It is a further object of the present invention to provide a new and improved jewelry apparatus which is of a durable and reliable construction.

An even further object of the present invention is to provide a new and improved jewelry apparatus which is susceptible of a low cost of maanufacture with regard to both materials and labor, and which accordingly is then susceptible of low prices of sale to the consuming public, thereby making such jewelry apparatus economically available to the buying public.

Still yet another object of the present invention is to provide a new and improved jewelry apparatus which provides in the apparatuses and methods of the prior art some of the advantages thereof, while simultaneously overcoming some of the disadvantages normally associated therewith.

Still another object of the present invention is to provide a new and improved jewelry apparatus wherein the same provides for a panel construction for ease of assembly of various of such panels together to provide a covering for a jewelry member.

These together with other ojects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
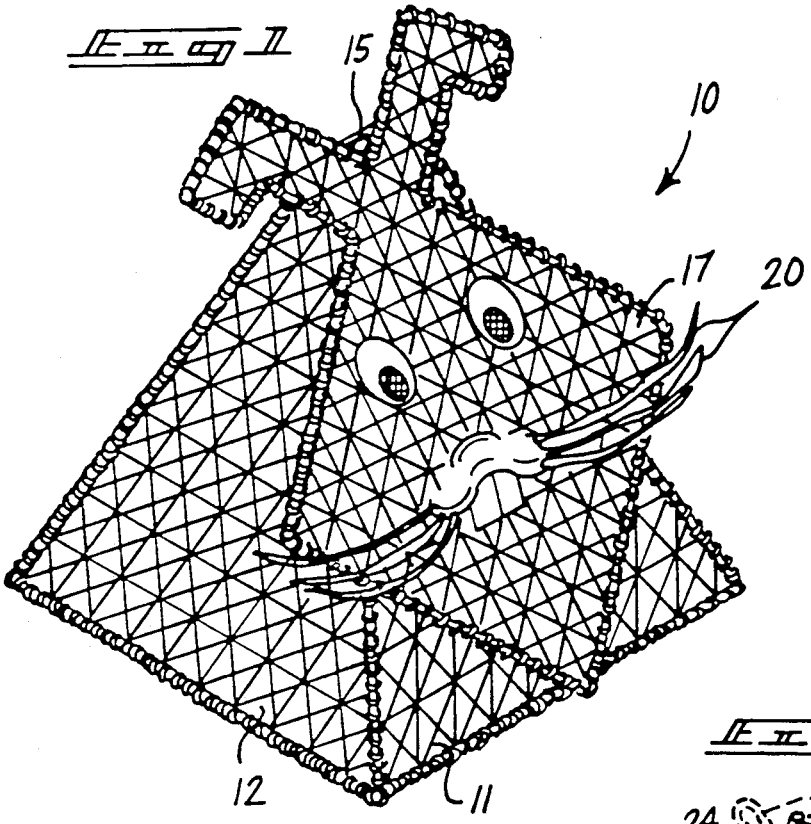
FIG. 1 is an isometric illustration of the instant invention.
Figure 2:
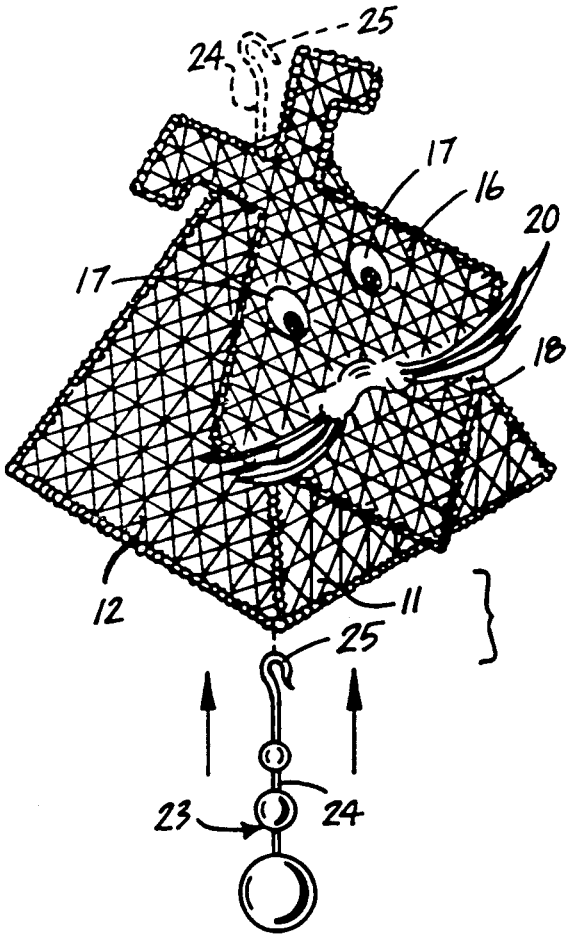
FIG. 2 is an isometric illustration of the instant invention in association with an earring member.

With reference now to the drawings, and in particular to FIGS. 1 to 8 thereof, a new and improved jewelry apparatus embodying the priciples and concepts of the present invention and generally designated by the reference numerals 10, 10*a*, and 10*b* will be described.

Figure 3:
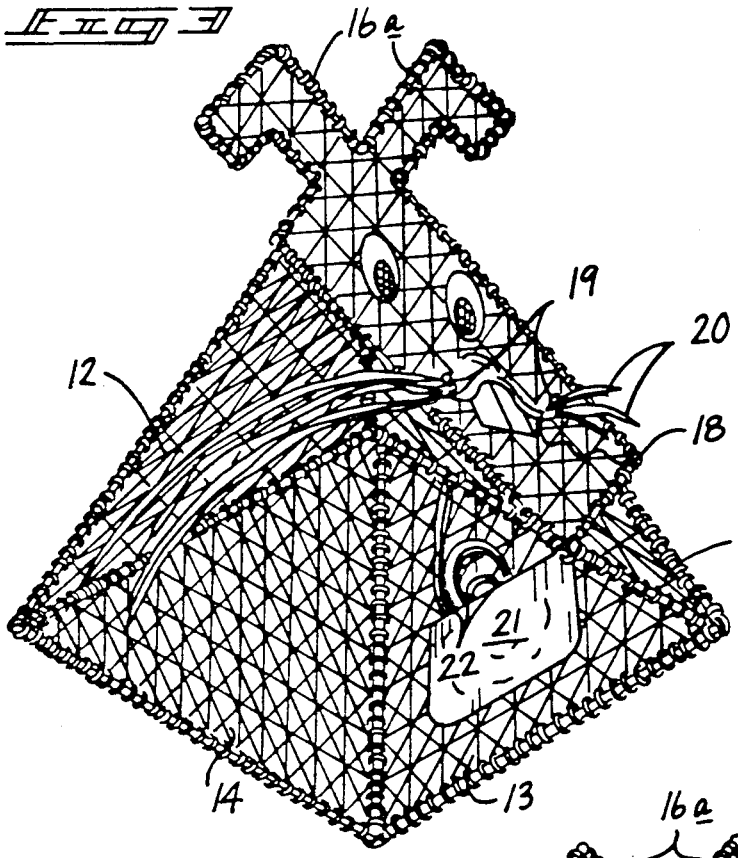
FIG. 3 is a bottom isometric illustration of the instant invention.
Figure 4:
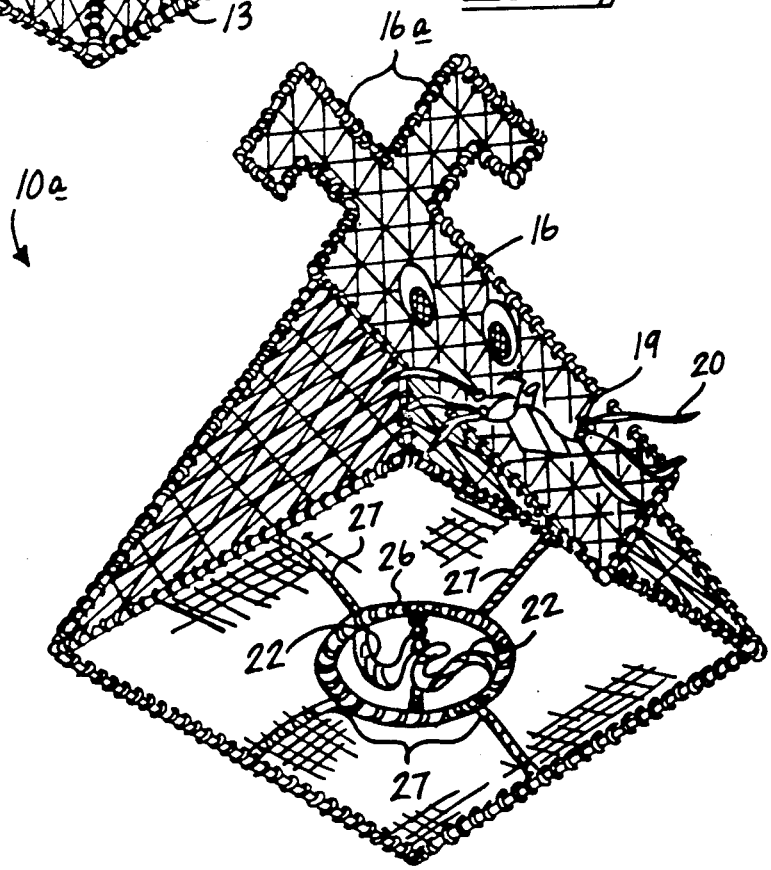
FIG. 4 is a bottom isometric illustration of a further embodiment of the instant invention.
Figure 5:
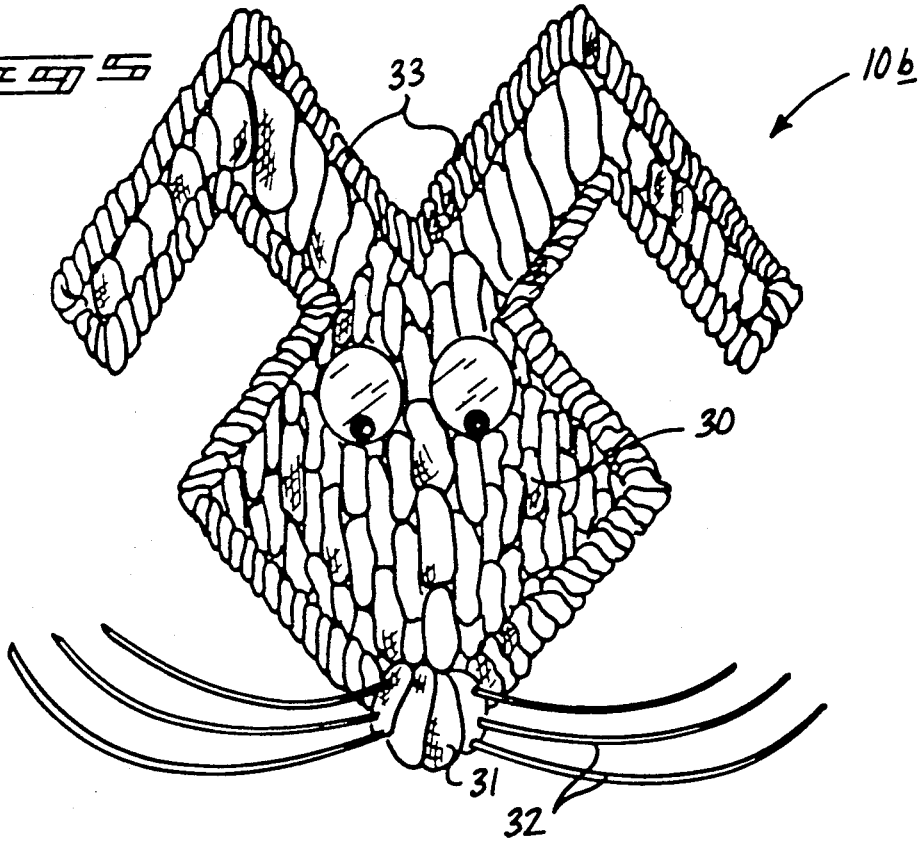
FIG. 5 is a frontal elevational view of the earring assembly utilized by the instant invention.

More specifically, the jewelry apparatus 10 of the instant invention essentially comprises a front, triangular panel 11, a first side triangular panel 12, a second triangular side panel 13, and a rear triangular panel 14. The panels are secured together to form the construction, where it is understood that equilateral triangles define the various side panels to permit their assemblage. When secured together, a top aperture 15 is provided at the upper apex of each of the side panels, for purposes to be described in more detail below. A generally diamond shaped cover panel 16 is provided, with a plurality of eye member 17 adhesively mounted thereto, and further including a plurality of projecting "L" shaped ear flaps to define an animal-like configuration, with an associated nose and mouth member 18 secured thereto. The nose and mouth member 18 incudes a plurality of nose member openings 19 (see FIG. 3 for example) to mount yarn filament end portions 20 therethrough. Reference to FIG. 3 illustrates the invention utilizing a yarn pouch 20 secured to an interior surface of a side panel, with yarn filament member 22 mounted therein to provide a reservoir of the filament member to permit an individual to selectively pull yarn filament end portions 20 through the associated openings 19 to provide decorative portions of a predtermined length, where it is understood that the filament members 22 may be drawn back into the yarn or reservoir pouch 21 as desired. An earring member 23 is provided, including a central shaft 24 that is directed through the top aperture 15, with an upper clasp end 25 projecting above the panel members 11, 12, 13, and 14 for securement to an individual's ear lobe. FIG. 4 illustrates a modified assemblage 10*a*, wherein a yarn support ring 26 is secured by radially mounted support filament 27 directed from the ring 26 to opposed side panels, wherein the ring secures a predetermined quantity of the yarn filament members 22 for directing the filament members through the associated openings 19, as discussed above. Further, the use of a tent stitch and a back stitch may be utilized as required.

Further, a necklace member may be provided wherein only the cover panel 16 is utilized, wherein similarly, ring member may be utilized with a tent stitch and overcast stitch for securing an encompassing filament or yarn member directed about opposed sides of the cover panel 16.

Further, the side panels 11–14 and cover panel 16 may be provided and formed by an individual utilizing a tent stitching procedure and assembled utilizing overcast stitching. Various adhesives may be utilized to mount various characteristics to the forward or outer surface of the cover panel 16.

Further, three side panel members, such as 11, 12 and 13 may be utilized to provide a pyramidal construction if desired.

Figure 6:
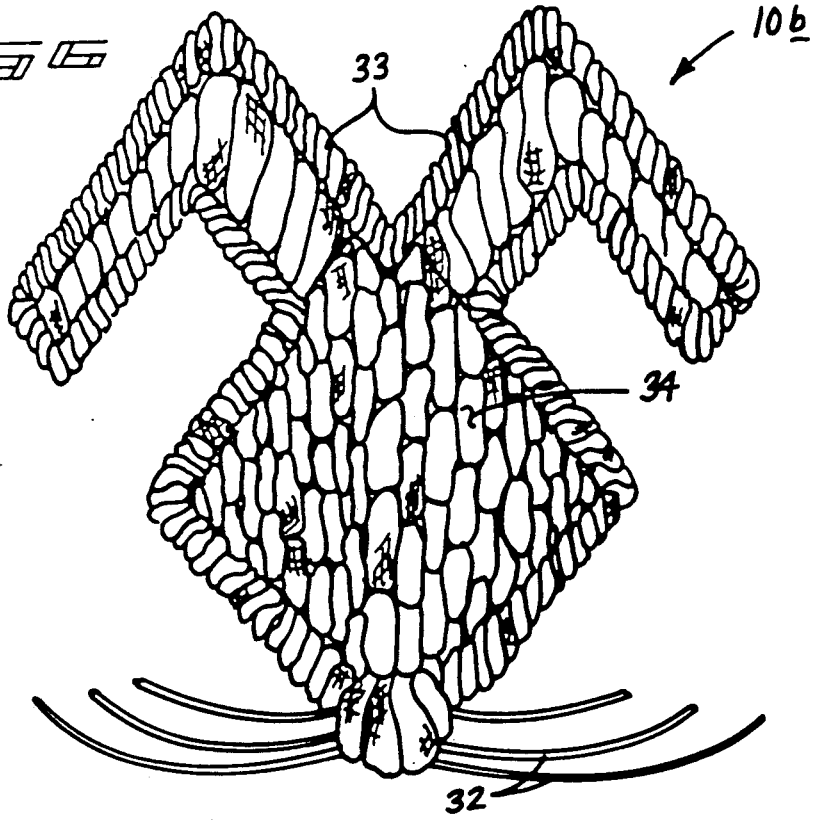
FIG. 6 is a rear elevational view of the earring assembly utilized by the instant invention.
Figure 7:
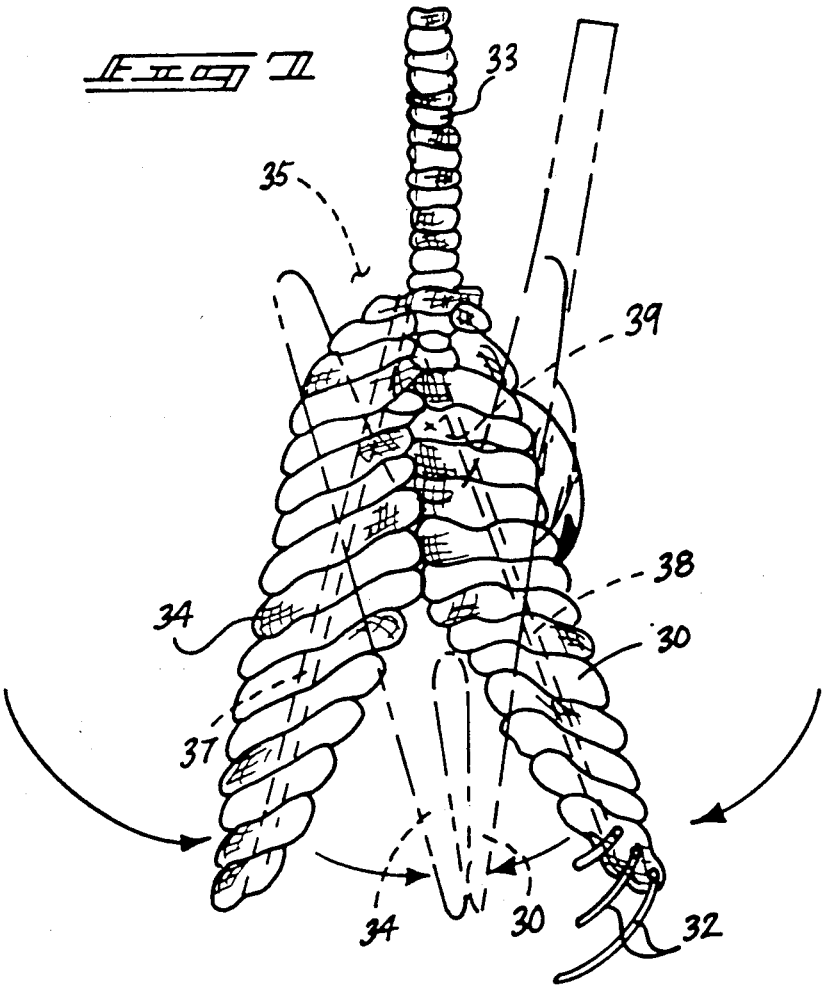
FIG. 7 is an orthographic side view, taken in elevation, of the front and rear panels spread apart (as illustrated in phantom) to define a slot for receiving ear lobes therewithin.
Figure 8:
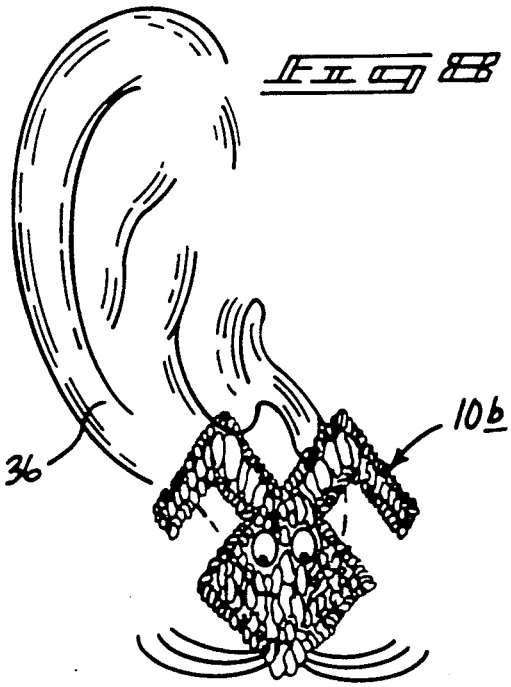
FIG. 8 is an orthographic frontal view of the earring assembly mounted to an individual's ear lobe.

FIG. 5–8 set forth a modified jewelry apparatus, wherein an earring assembly 10*b*is defined by a frontal, diamond-shaped panel 30 and a mating rear diamond-shaped panel 34 of a complementary configuration. A lowermost portion of the frontal panel includes the projection mounting a matrix of whisker filaments 32 laterally thereof, with a plurality of simulated eye portions mounted above the projection 31 for simulation of an animal-like visage. A plurality of "L" shaped leg portions 33 are intergrally mounted to the frontal panel 30 to an uppermost apex portion thereof. The rear panel 34 overlies the frontal panel 30, as illustrated in FIG. 6. A slot 35 is defined when the lowermost apex portion of the frontal and rear panels 30 and 34 respectively are projected towards one another, as illustrated in phantom in FIG. 7, to define the slot 35 that may subsquently receive an ear lobe 36, as illustrated in FIG. 8. A first plate 37 and a second plate 38 are mounted within the rear and frontal panels 34 and 30 respectively, including a spring hinge portion 39 to normally bias the panels in a first position, wherein upper apex corners of the frontal and rear panels are in contiguous communication with one another. Upon depressing the lowermost apex portions of each of the frontal and rear panels to a second position, as illustrated in phantom in FIG. 7, the slot 35 is thusly defined permitting mounting of the earring assembly 10*b* onto the ear lobe.

As to the manner of usage and operation of the instant invention, the same should be apparent from the above disclosure, and accordingly no further discussion relative to the manner of usage and operation of the instant invention may be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A jewelry apparatus comprising, a front triangular panel, at least one side triangular panel, and a rear triangular panel, and the triangular panels each including side edges and a bottom edge, and the triangular panels secured together at contiguous side edges and defining a bottom opening defined by the bottom edges of the side panels, and a top aperture directed through an upper end of the assembly, and an earring member including a central shaft and an upper clasp end mounted to an upper end of the central shaft, with the clasp member directed through the top aperture spaced above the side panels for securement to an ear lobe.

2. A jewelry apparatus as set forth in claim 1 wherein the triangular side panels are each of an equilateral triangular construction.

3. A jewelry apparatus as set forth in claim 2 wherein the side edges of each triangular panel define an upper apex, and the aperture is directed at an intersection of each upper apex of each triangular side panel.

4. A jewelry apparatus as set forth in claim 3 further including a cover panel mounted overlying the front triangular panel, the cover panel including a plurality of eye members adhesively mounted to the front panel, and a nose and mouth member mounted underlying the eye members.

5. A jewelry apparatus as set forth in claim 4 with a plurality of nose member openings directed through the nose and mouth member, with a yarn filament end portion directed through each nose member opening.

6. A jewelry apparatus as set forth in claim 5 including a yarn reservoir pouch mounted to an interior surface of the at least one triangular side panel, with the yarn reservoir patch including a plurality of filament members, and each filament member slidably directed through a respective nose member opening to permit selective extension and retraction of a respective yarn filament end portion.

* * * * *